US005328200A

United States Patent [19]

Pelizzari

[11] Patent Number: 5,328,200

[45] Date of Patent: Jul. 12, 1994

[54] SKI OR OTHER MACHINE OR BOARD FOR SLIDING OVER SNOW, WITH SCORED SOLE

[75] Inventor: Jean-Luc Pelizzari, Coublevie, France

[73] Assignee: Skis Rossignol SA, Voiron, France

[21] Appl. No.: 979,046

[22] Filed: Nov. 19, 1992

[30] Foreign Application Priority Data

Nov. 19, 1991 [FR] France ..... 91 14525

[51] Int. Cl.[5] ..... A63C 5/044

[52] U.S. Cl. ..... 280/609; 280/28

[58] Field of Search ..... 441/68; 280/609, 28, 280/610, 601, 845

[56] References Cited

U.S. PATENT DOCUMENTS 3,378,274 4/1968 Poppen ..... 280/609 X

FOREIGN PATENT DOCUMENTS 182997 8/1955 Austria ..... 280/609
1108599 6/1961 Fed. Rep. of Germany ..... 280/609
2623852 12/1976 Fed. Rep. of Germany ..... 280/609
934319 3/1948 France ..... 280/609

*Primary Examiner*—Margaret A. Focarino
*Assistant Examiner*—Michael Mar
*Attorney, Agent, or Firm*—Browdy and Neimark

[57] ABSTRACT

A machine or board for sliding over snow, such as a ski, monoski, snow surfer, sledge, sleigh, . . ., has a sole provided with longitudinal scores. The scores are not rectilinear, but present an undulated form, typically of sinusoidal appearance, which gives this machine or board a much improved slide characteristic.

22 Claims, 2 Drawing Sheets

SKI OR OTHER MACHINE OR BOARD FOR SLIDING OVER SNOW, WITH SCORED SOLE

FIELD OF THE INVENTION

The present invention relates to a snow ski or other machine or board for sliding over snow, such as snow surfer, monoski, sledge, sleigh or the like, the sole of such machine or board being provided with scores oriented substantially in the longitudinal direction.

BACKGROUND OF THE INVENTION

The phenomena associated with the slide of the plastic sole of a ski over snow are still barely known. Contrary to what may be thought a priori, a totally smooth sole does not slide well over the snow, most probably by reason of the films of water which tend to form on this plastic sole by the friction of the ski over the snow or ice.

This has mot escaped the specialists and a large number of Patents have been filed within the last ten years or so, describing, in ever greater detail, the possible use of skis whose plastic sole, which forms the slide surface, is provided with longitudinal rectilinear scores.

By way of illustration of this state of the art, the following documents may be cited, in chronological order clearly showing the historical development of these proposed skis with grooved sliding sole: CH-A-161.592, AT-A-182.997, FR-A-1.102.116, DE-A-1.108.599, FR-A-2.314.739 and FR-A-2.654.005. In all these documents, the scores are longitudinal and rectilinear:

One highly probable explanation for the use of these scores is that they allow evacuation and break of the films of water which form beneath the sole of the ski when it slides over snow or ice.

It has generally become apparent that the sliding of a ski was strongly influenced by the roughness Ra of its sole, the creation of straight, longitudinal scores having, among other beneficial effects, that of increasing, in manner easily adjustable when machining the sole, the roughness of said sole, all this being, moreover, most probably linked with the above-mentioned phenomenon of formation of films of water beneath this sole.

However, in Applicants' opinion and taking into account the increasing requirements of skiers who are constantly seeking to improve their performances, such straight scores have not appeared to provide an increase in the sliding performances sufficient to satisfy present requirements, particularly in competitive ski-ing.

SUMMARY OF THE INVENTION

It is therefore an object of the present invention to propose a machine or board for sliding over snow, such as ski, monoski, snow surfer, sledge, sleigh, of which the snow-slide performances are improved with respect to those of sliding boards or machines of the prior art. To that end, the invention relates to a machine or board for sliding over snow, such as a ski or the like (monoski, snow surfer, sledge, sleigh, . . .), said machine or board being characterized in that its sliding sole is provided with scores which are overall oriented in the longitudinal direction of the ski and which each present an undulating shape of generally sinusoidal appearance.

These scores are multiple, the same width of the ski being able to contain several tens or even many more, and they are, in principle, very fine.

They each define undulations whose amplitude may preferably vary from 0.05 mm to 2 mm, the mean period (or pitch) of these undulations preferably being included between 2 and 100 mm.

Preferably they are very fine, their width being for example between 0.05 and 4 mm, and shallow: their depth is typically included between 10 and 50 microns for example.

They may be short, their length (projected over their longitudinal axis) being as little as about 3 mm, and separated longitudinally by non-scored zones, or they may be more or less long, each possibly extending over the whole length of the ski sole.

Generally, they are designed as a whole in order preferably to give the sliding sole a coefficient of roughness Ra substantially included between 2 and 8.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
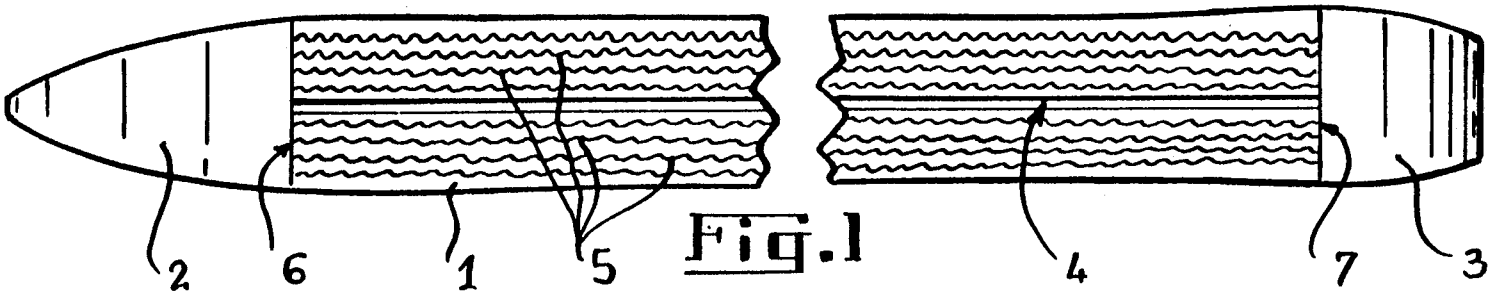
FIG. 1 shows, in a view from underneath, a first embodiment of the ski according to the invention.
Figure 2:
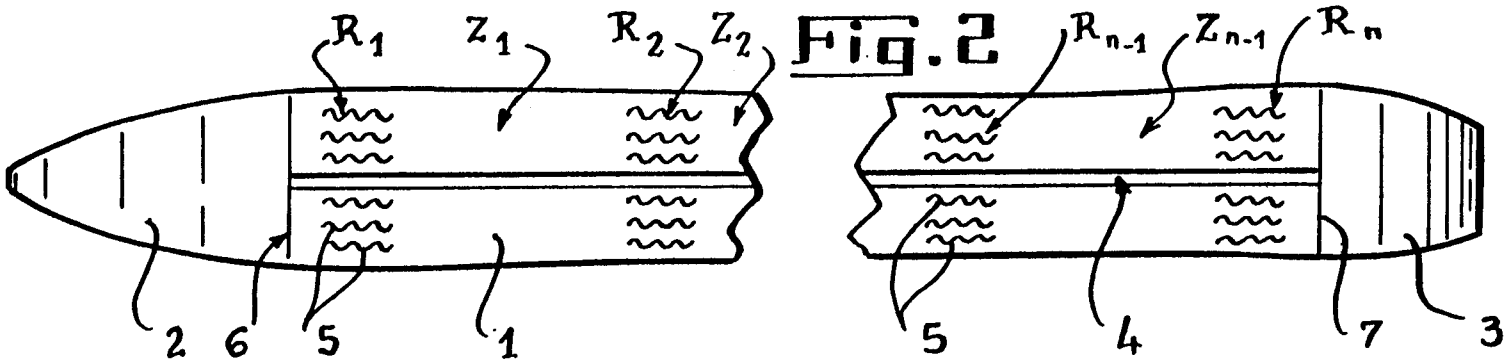
FIG. 2 shows, in the same way, another embodiment of this ski.

Referring now to the drawings, and firstly to FIGS. 1 and 2, the ski according to the invention, which, in this example, is an alpine ski but may equally well be a cross-country ski or a ski for jumping, is shown in a view from underneath. The Figures show a slide sole 1 which, at the present time, is currently made of plastics material, the underneath 2 of the tip thereof and the underneath 3 of its tail.

The sole 1 may or may not have a deep, wide, longitudinal groove 4 hollowed out therein, merged with the median longitudinal axis of the ski.

Figure 3:
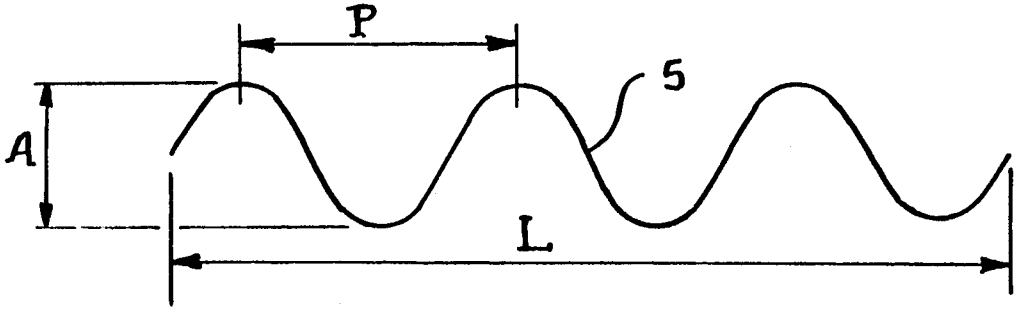
FIG. 3 is a much enlarged view of one of the scores with which the sole of such a ski is provided.

In order to improve the performances of slide of this ski over snow or ice, the plastic sole 1 has a multitude of very fine non-rectilinear scores 5 made therein, overall oriented in the longitudinal direction and which are undulated in sinusoidal manner, as is more clearly apparent along their centerlines in FIG. 3 which shows at least one portion of score 5 in much enlarged view.

In FIG. 1, the undulated scores 5, which are parallel to one another, extend continuously along the active part of the sole 1, i.e. from the point of origin 6 of the tip 2 to the point of origin 7 of the tail 3.

On the contrary, in FIG. 2, the undulated scores 5 are short, with a projected length of 3 to 10 mm each for example, and they are distributed along the sole 1 in several transverse rows R1, R2, . . . Rn-1, Rn, of parallel scores 5 as shown, each row being separated from the following by a non-scored zone Z1, Z2, ... Zn-1.

In FIGS. 1 and 2, only a few scores (eight and six respectively) have been shown for the same transverse section, in order to render the drawings clearer. In fact, the sole 1 of the ski according to FIG. 1 comprises several tens of scores 5, and even more, and the same applies for each row R1, R2, . . . of scores 5 of the sole 1 of the ski of FIG. 2.

FIG. 3 shows a much enlarged score 5 and, in this example, it presents a sinusoidal form. In fact, in order to carry out the invention, it suffices that this form be undulated, which forcibly gives it an overall sinusoidal "appearance" but it is not necessarily a pure sinusoid and its pitch P and amplitude A are, moreover, not necessarily regular.

Figure 7:
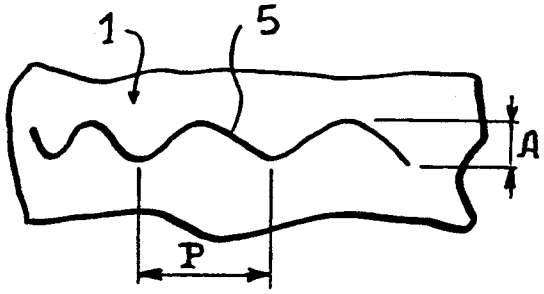
FIGS. 7 and 8 show other forms of scores according to the invention.
Figure 8:
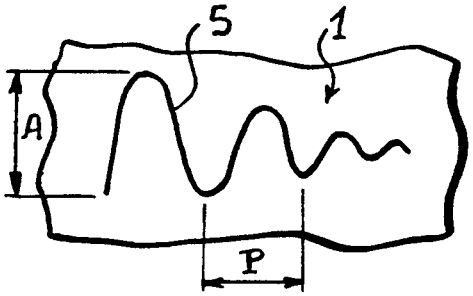

On this subject, FIG. 7 shows a possible form of scores 5 of constant amplitude A and of variable pitch P, whilst, on the contrary, FIG. 8 shows a score 5 of constant pitch P and of variable amplitude A. A combination of these two configurations is also possible and, in that case, the score 5 would be with amplitude A and pitch P which are both variable. Such scores may also be combined with others such as those of FIG. 3.

Figure 4:
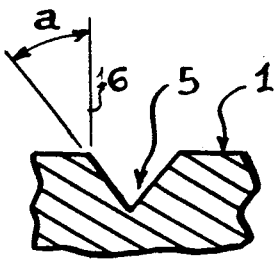
FIGS. 4 to 6 show three preferred forms of section for these same scores.
Figure 5:
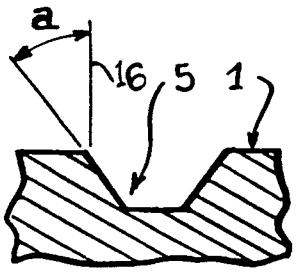
Figure 6:
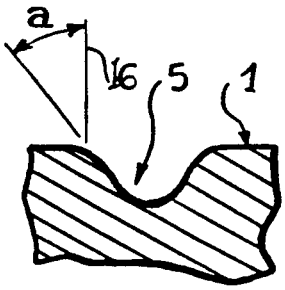

The section given to the scores is of considerable importance. Applicants have found that it was advantageous, for an optimum circulation of the film of water, to give these scores 5 a section presenting an angle "a" with the perpendicular 16 to the plane 1 of the sole, and in particular: a "V"-section (FIG. 4), a trough section with flat bottom and inclined edges (FIG. 5) or dish-section with rounded edges (FIG. 6).

This angle "a" has been found to be preferably included between 30° and 80° for an optimum result.

The ascertainment of the surprising improvement of the slide of a ski provided, on its slide sole, with such undulated scores, is purely by rule-of-thumb and it was found after long experimental research.

The undulated scores 5 probably facilitate, already at low speeds, separation of the slide surfaces in contact with the snow and they allow an evacuation of the films of water formed beneath the sole. However, Applicants cannot, at the present time, give any scientific explanation as to why these undulated scores lead to a much better result than the rectilinear scores of the prior art.

Following numerous experiments and trial-and-error tests, Applicants have been able to determine that this surprising improvement in the sliding properties was obtained especially with scores 5 of substantially sinusoidal appearance, either strictly oriented along the longitudinal axis of the ski or presenting a maximum inclination of 25% with respect to this longitudinal axis, with the following technical characteristics:

- Coefficient of roughness given to the sole 1 by these scores 5: included between 2 and 8.
- Depth of the scores: included between 10 and 50 microns.
- Projected length L (FIG. 3) of these scores: from 3 mm minimum (FIG. 2) to the whole length of the ski (FIG. 1).
- Length of zones Z1, Z2, . . ., between transverse rows of scores: less than 20 mm.
- Amplitude A (FIG. 3) of the undulations of a score: included between 0.05 mm and 2 mm.
- Period (or pitch) P (FIG. 3) of these undulations: included between 2 and 100 mm.
- Width of these scores: included between 0.05 and 4 mm and, as illustrated, preferably of constant width These scores 5 are made on the sole 1 of the ski either by grinding or by milling.

If, for example, a ski presents a coefficient of roughness Ra less than 2, the slide characteristics of this ski will be considerably increased on wet snow if the scores according to the invention are made.

However, this evolution of the slide characteristics will be less spectacular on dry snow.

Finally, for a ski whose sole presents, before being scored, a coefficient of roughness Ra greater than 2, the shape given to the roughness of the undulated scores 5 seems more important than this value Ra itself.

It goes without saying that the invention is not limited to the embodiments which have just been described. It is applied to any board for sliding whatever: alpine ski, cross-country ski, monoski, snow surfer, etc. . . as well as to any sliding machine such as a sledge, sleigh or the like.

Figure 9:
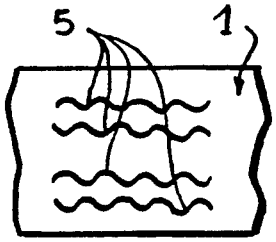
FIGS. 9 to 14 show other possible arrangements for this assembly of scores.
Figure 10:
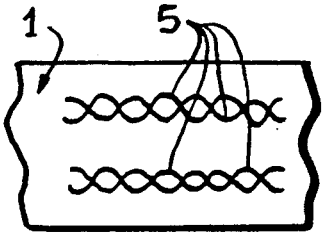
Figure 11:
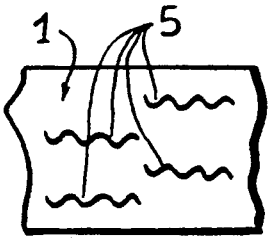
Figure 12:
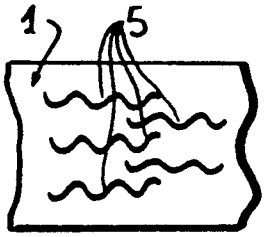
Figure 13:
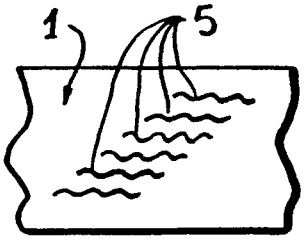
Figure 14:
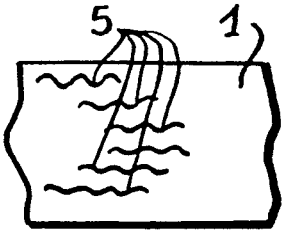

The undulated scores 5 are not necessarily positioned in the form of parallel sinisoids in phase, as in FIGS. 1 and 2. All or certain of them may also, for example, be:

- parallel but offset, and even in phase opposition (FIG. 9) on the same row;
- entangled (FIG. 10);
- offset laterally from one row of parallel scores to the following (FIG. 11);
- disposed in rows imbricated in one another (FIG. 12);
- disposed tn rows forming an angle with the transverse axis of the ski (FIG. 13);
- disposed in "V" or chevron form (FIG. 14).

What is claimed is:

1. A machine or board for sliding over snow, such as a ski or the like, comprising at least one slide sole provided with a plurality of scores extending into the slide sole, each of said scores having a substantially constant width and a centerline substantially oriented in a longitudinal direction of the machine or board, the centerline of each of said scores having a plurality of undulations extending transversely to the longitudinal direction to form an undulated pattern.

2. The machine or board of claim 1, wherein at least several tens of said undulated scores lie side by side over the width thereof.

3. The machine or board of claim 1, wherein the undulations of each of the centerlines of the scores present an amplitude between 0.05 and 2 millimeters.

4. The machine or board of claim 1, wherein the pitch of the centerlines of the undulations formed by each score is between 2 and 100 millimeters.

5. The machine or board of claim 1, wherein said undulated scores are fine and shallow, their width being typically between 0.05 and 4 millimeters and their depth typically between 10 and 50 microns.

6. The machine or board of claim 1, wherein said undulated scores are long extending over substantially the whole length of the sole.

7. The machine or board of claim 1, wherein said undulated scores length have a minimum length of being as little as about 3 millimeters.

8. The machine or board of claim 7, wherein said undulated scores are up to about 10 mm in length and are disposed in successive transverse rows separated from one another by unscored zones.

9. The machine or board of claim 8, wherein said separation zones have a length less than about 20 millimeters.

10. The machine or board of claim 1, wherein said undulated scores give the sole of said board a coefficient of roughness between 2 and 8.

11. The machine or board of claim 1, wherein said undulated scores have a section which presents an angle with respect to the perpendicular to the surface of the sole, said angle being included between 30° and 80°.

12. The machine or board of claim 1, wherein at least some of said scores are of constant amplitude and of variable pitch.

13. The machine or board of one of claim 1, wherein at least some of said scores are of constant pitch and of variable amplitude.

14. The machine or board of one of claim 1, wherein at least some of said scores are of pitch and amplitude which are both variable.

15. The machine or board of one of claim 1, wherein at least some of said scores are, on the same row, offset, and even in phase opposition.

16. The machine or board of one of claim 1, wherein at least some of said scores are entangled.

17. The machine or board of one of claim 1, wherein at least some of said scores are arranged in rows offset laterally from one row to the following.

18. The machine or board of claim 17, wherein at least some of said scores are imbricated in one another.

19. The machine or board of claim 1, wherein at least some of said scores are disposed in inclined rows with respect to the transverse axis of said machine or board.

20. The machine or board of claim 1, wherein at least some of said scores are disposed in "V" or chevron form.

21. The machine or board of claim 2 wherein the undulations of each of the centerlines of the scores present an amplitude between 0.05 and 2 mm and a pitch between 2 and 100 mm.

22. The machine or board of claim 21 wherein said undulated scores are fine and shallow, having a width between 0.05 and 4 mm and a depth between 10 and 50 microns, said undulated scores having a minimum length of about 3 mm and sidewalls inclined with respect to the perpendicular to the surface of the sole between 30° and 80°, said scores being sinusoidal in appearance and having a maximum inclination of 25% with respect to the longitudinal axis of the machine or board, and providing said sole with a coefficient of roughness between 2 and 8.

* * * * *